US008430042B2

(12) United States Patent
Hillenbrand et al.

(10) Patent No.: US 8,430,042 B2
(45) Date of Patent: Apr. 30, 2013

(54) TUFTING KNIFE WITH A NOMINAL BENDING POINT

(75) Inventors: Bernd Hillenbrand, Albstadt (DE); Roland Vogler, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/275,850

(22) Filed: Oct. 18, 2011

(65) Prior Publication Data

US 2012/0103239 A1 May 3, 2012

(30) Foreign Application Priority Data

Oct. 27, 2010 (EP) ..... 10189110

(51) Int. Cl.
*D05C 15/24* (2006.01)

(52) U.S. Cl.
USPC ..... 112/80.55

(58) Field of Classification Search ..... 112/80.55, 112/80.56, 80.57, 80.58, 80.59, 80.6
See application file for complete search history.

(56) References Cited

U.S. PATENT DOCUMENTS

| | | | | |
|---|---|---|---|---|
| 3,357,290 A | | 12/1967 | Neale | |
| 3,595,184 A | * | 7/1971 | Watkins | 112/80.53 |
| 3,735,715 A | * | 5/1973 | Passons et al. | 112/80.51 |
| 3,820,482 A | * | 6/1974 | Woodcock | 112/80.53 |
| 3,880,101 A | * | 4/1975 | Passons | 112/80.55 |
| 3,913,505 A | * | 10/1975 | Crumbliss et al. | 112/80.53 |
| 4,067,270 A | | 1/1978 | Short | |
| 4,193,359 A | * | 3/1980 | Beasley | 112/80.3 |
| 4,207,826 A | | 6/1980 | Edwards | |
| 4,602,576 A | * | 7/1986 | Cox | 112/80.55 |
| 6,192,814 B1 | * | 2/2001 | Beverly | 112/80.55 |

FOREIGN PATENT DOCUMENTS

| | | |
|---|---|---|
| DE | 1535764 B1 | 2/1970 |
| DE | 2745793 A1 | 4/1979 |
| DE | 2856344 A1 | 7/1979 |
| EP | 0229525 A2 | 7/1987 |
| GB | 487478 A | 6/1938 |
| GB | 1087196 A | 10/1967 |

* cited by examiner

*Primary Examiner* — Danny Worrell
(74) *Attorney, Agent, or Firm* — Fitch, Even, Tabin & Flannery, LLP

(57) ABSTRACT

An improved tufting knife (20) has, at a distance from its cutting edge (36), a bending joint (27) from which extends one leg (26) to the cutting edge (36) and another leg (25) to a knife bar (21). The bending joint (27) ensures that the tufting knife (20) is highly flexible and that a desired contact pressure between the tufting knife (20) and the gripper (18) is maintained largely independently of the degree of lateral flexion and/or bending of the tufting knife (20). This has a strongly wear-reducing effect.

8 Claims, 3 Drawing Sheets

TUFTING KNIFE WITH A NOMINAL BENDING POINT

CROSS-REFERENCE TO RELATED APPLICATION

The present application claims the priority of European Patent Application No. 101 89 110.9, filed Oct. 27, 2010, the subject matter of which, in its entirety, is incorporated herein by reference.

BACKGROUND OF THE INVENTION

The invention relates to a tufting knife for a tufting machine for the production of cut pile.

Tufting machines for the production of cut pile have basically been known and have been in use for a long time. For example, document DE 27 45 793 C discloses a tufting machine, said machine comprising always the same basic components including a reed with reed fingers for supporting the planar backing material, a bar with tufting needles for rhythmically piercing the backing material and for thus pulling the thread loops into the backing material, a gripper bar with grippers for picking up the produced loops, and a knife bar with knives for cutting open said loops. In the course of the loop-forming process the knife bar and the gripper bar are moved relative toward each other in such a manner that, respectively, one knife abuts against the lateral surface of each gripper, pushes against said lateral surface, and then uses its cutting edge to cut through one or several of the loops picked up by the gripper. This process proceeds reliably only if the knives are pressed against the flanks of the griper so that the resultant cutting gap between the cutting edge of the gripper and the cutting edge of the knife is close to zero.

The knife contact pressure existing between the knife and the gripper causes the grippers and also the knives to be worn, thus limiting the useful life of the knife and/or the gripper. This is true, in particular, when the gripper comprises a hard metal insert that has an increased abrasive effect on the knife.

For example, tufting grippers and tufting knives comprising a hard metal cutting body affixed by soldering are known from DE 1 535 764.

Furthermore, DE 28 56 344 discloses the mounting of tufting knives in a knife block on a bar. As is obvious, the knife block is adapted to the thickness of the knives. If knives displaying greater flexibility and consequently lower thickness are to be used, the knife block must be changed. This represents a considerable expense.

SUMMARY OF THE INVENTION

It is the object of the invention to disclose a concept with which the useful life of at least one of the involved tools in tufting devices can be increased.

The above object generally is achieved with the tufting knife in accordance with the invention which comprises a strip-shaped base body having a cutting edge on its end. At some distance from the cutting edge, there is a bending joint that defines a bending axis extending transversely to the base body. The bending joint divides the base body into two legs that are elastically connected to each other via the bending joint. One of the legs has a cutting edge, whereas the other leg can be anchored to a knife block. Due to the bending joint, the bending point and thus the position and angular alignment of the leg having the cutting edge can be adjusted in a controlled manner. In addition, the contact force between the tufting knife and the gripper can be adjusted as desired, regardless of the thickness of the tufting knife. As a result of this, good control over the position of the knife as well as over the forces acting on said knife and on the gripper is a given. In particular, it is possible to prevent excessive knife wear and/or excessive gripper wear.

The bending joint or bending hinge is a spring loaded hinge that ensures not only the mobility of the two legs of the tufting knife relative to each other but, at the same time, acts as a leaf spring. Preferably, the spring loaded hinge is configured so as to represent one part with the remaining base body, i.e., said hinge consists of the same material as said base body and adjoins said base body in a seamless and gapless manner. Basically, however, it is also possible to design the spring loaded hinge as a separate element that is connected to the two legs of the tufting knife by laser weld seams or by means of other joining methods, for example.

Due to its simplicity, the one-part, one-piece embodiment of the bending hinge with the base body is considered the advantageous embodiment. For example, the resilient section representing the spring loaded hinge may have a lower material thickness than the remaining base body. This may be adapted so as to represent a troughed recess that extends from one longitudinal edge of the tufting knife to its other longitudinal edge. The two longitudinal edges may be straight edges or also follow curves or steps or other types of contours. The trough-shaped recess or indentation can be provided on only one of the flat sides of the tufting knife; however, it is also possible to provide a trough-shaped indentation on both sides. Preferably, this recess extends across the entire width of the flat side, i.e., preferably, again, at a constant cross-section.

The recess may have different cross-sectional forms. Preferably, the recess is shaped to have a rounded bottom, so that the trough becomes flatter as it approaches the two edges. For example, the trough represents a circular indentation having an arcuate curvature. Starting from the edge of the trough, the material thickness decreases in longitudinal direction of the tufting knife toward the center of the trough in order to increase again from there toward the next edge. In the center of the trough, the material thickness of the bending hinge is preferably 30% to 70%, even more preferably 40% to 60%, and, in the specific present embodiment, 50% of the material thickness of the remaining base body. Trough forms having other contours, e.g., a trapezoidal contour, are possible.

Preferably, the recess has a width to be measured in longitudinal direction of the tufting knife, said width being greater than the strip width of the base body to be measured transversely thereto. Furthermore, the recess follows a radius of curvature that is approximately twice as large as twice the width of the base body. The width of the base body is measured at this point of the recess from longitudinal edge to longitudinal edge of the base body. In addition, the distance of the center of the recess from the cutting edge is preferably smaller than half the radius of curvature and greater than one third of said radius of curvature.

By using these dimensions in a tufting knife having the usual thickness such as, for example 0.8 mm, and using the usual materials such as, for example steel, a flexibility is achieved that, on the one hand, leads to a sufficiently high contact pressure between the tufting knife and the gripper to ensure safe cutting of the picked up loops and, on the other hand, prevents excessive knife wear or gripper wear. For example, an inventive tufting knife having a thickness of 0.8 mm can provide the same contact pressure as a standard tufting knife having a thickness of 0.6 mm. It is of advantage that, when using a standard 0.8 mm knife holder, the use of the tufting knives provided with a bending joint makes an additional 0.6 or 0.65 mm knife block superfluous, such a knife block being otherwise necessary for the accommodation and mounting of softer, thinner knives.

The tufting knife in accordance with the invention enables a very simple adjustment of the tufting machine. The contact pressure of a tufting knife on the gripper, for example, can be adjusted by the lateral adjustment of the knife bar relative to the gripper bar in the tufting machine. In doing so, the adjustment must be such that, on the one hand, the tufting knife should not run into the oppositely arranged gripper at too great an impact, and that, on the other hand, a safe cutting function should also be ensured. Considering hard tufting knives, this adjustment must be performed with great sensitivity, so that the contact pressure is neither too great nor too small. In doing so, it is difficult to ensure the proper adjustment of all knives at the same time and to guarantee that, in addition, tolerances are maintained over extended periods of operation. The tufting knives provided with the bending joint in accordance with the invention are much more tolerant in this case.

Another advantage of the invention becomes particularly obvious in tufting knives with a cutting insert. For example, in prior art, the contact pressure of the tufting knife can be influenced by the thickness of said knife. However, this already approaches its limits when there are only knife holders for knives having a specific, e.g., great thickness. Furthermore, the measure reaches its limits in tufting knives with cutting inserts, e.g., inserts made of hard metal or ceramic. Such tufting knives consists of a carrier with a pocked or a recess for the accommodation of the cutting insert. If the carrier is too thin, the knife is weakened too much at the cutting knife receptacle, thus potentially leading to premature failure. Due to the bending joint of the tufting knife of the invention it is possible, in particular, to design thicker tufting knives with a cutting insert in a more flexible manner so that the knife pressure can be lowered to the value of the next thinner knife. The type of knife holder may remain the same.

Furthermore, the bending stresses in the tufting knife are concentrated on the bending joint and thus effectively kept away from the mostly brittle cutting inserts, so that said inserts will neither loosen nor develop fissures or breaks.

Additional details of advantageous embodiments of the invention can be inferred from the description, the dependent claims and the drawings. They show in

DETAILED DESCRIPTION OF THE INVENTION

Figure 1:
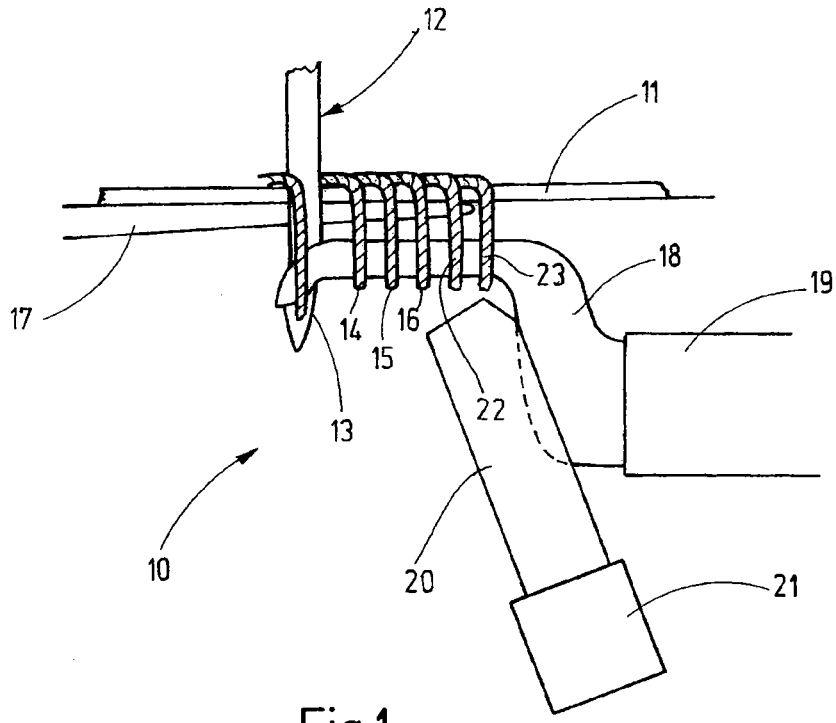
FIG. 1 is a side view of a basic diagram of a tufting device.

FIG. 1 shows a tufting device 10 that is used for the manufacture of tufted material such as, for example carpeting. This material consists, for example of a backing material 11 through which loops 13, 14, 15 and 16 are punched by means of tufting needles 12, said loops being intended to form the pile to be produced on the backing material 11. While the backing material is situated on a reed having reed fingers 17, the loops 13, 14, 15 and 16 are picked up by a gripper 18. This gripper is seated with additional congruent grippers of equal design in modules or is directly seated on a gripper bar 19, said grippers being moved in a work cycle that is synchronous to that of the tufting needles 12 for picking up the loop 13, 14, 15, 16 that has been newly formed whenever the backing material 11 is pierced. A large number of tufting needles 12 is held on an appropriate, not specifically illustrated, needle bar.

The tufting knives 20 interact with the grippers 18, said knives being held on a knife bar 21. The knife bar 21 is moved against the gripper bar 19, so that the knives 20 cut open the loops that are seated on the gripper 18 in order to create the desired cut pile. FIG. 1 shows two such cut open loops 22, 23.

Figure 2:
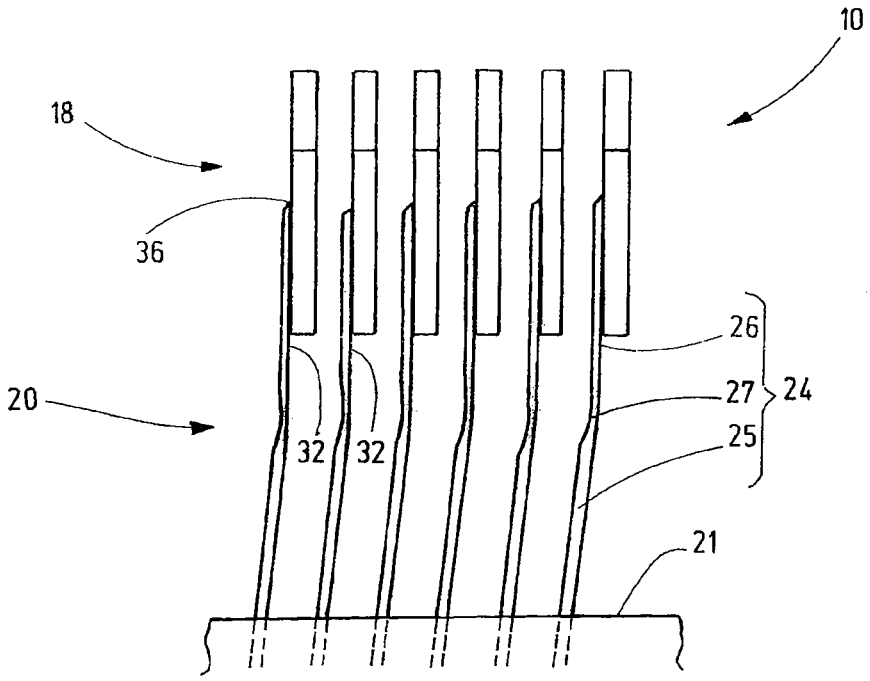
FIG. 2 is a front view of the tufting device as in FIG. 1.

FIG. 2 shows a front view of the tufting device 10, in which case the depiction is reduced to the grippers 18, the tufting knives 20 and the knife bar 21. Inasmuch as the grippers 18 are equally configured among each other, the grippers 18, individually or in total, are identified by the same reference sign. This applies, analogously, to the knives 20.

As can be seen, each knife 20 has a base body 24 associated with a holding leg 25, a cutting leg 26 and an interposed bending joint 27. The bending joint 27 seamlessly terminates in the adjoining legs 25, 26 and consists of the same material as said legs. Generally, said joint is formed in each of the embodiments described hereinafter by a zone of reduced material thickness. Independently thereof, the bending element 27 can also be made as a separate element, e.g., a spring steel section, that is connected with the adjoining legs 25, 26, e.g., by welding spots or weld seams.

Figures 3, 4, 5:
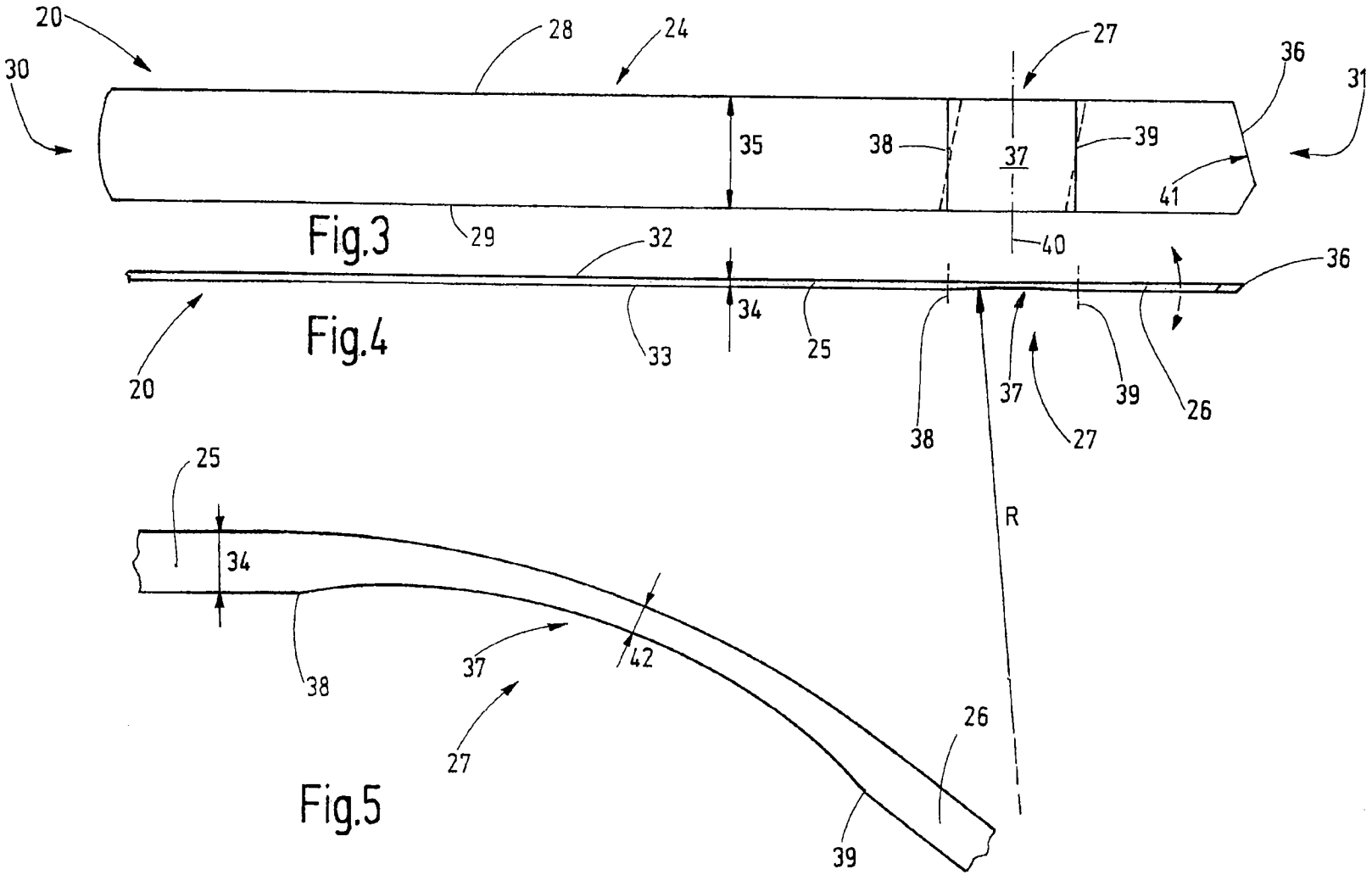
FIG. 3 is a side view of a tufting knife.
FIG. 4 is a rear view of a tufting knife.
FIG. 5 is an enlarged, not true to scale, representation of the bending joint of the tufting knife.

FIG. 3 is a separate illustration of the tufting knife 20. Its strip-shaped base body 24 has two longitudinal edges 28, 29, said edges being straight in the present exemplary embodiment and extending from a holding-block-side end 30 to a cutting-edge-side end 31. As shown, the longitudinal edges 28 may be straight or also have different forms that comprise corners, steps, undulations or other contours, for example.

Preferably, the base body 24 consists of a strip-shaped sheet metal section of a suitable metal or of a material that can be similarly stressed. Between its flat sides 32, 33 (see FIG. 4), a measured thickness 34 needs to exist, said thickness being substantially smaller than the width 35 measured between the longitudinal edges 28, 29.

At the end 31, the tufting knife 20 is provided with a cutting edge 36 that may be straight, undulated, toothed or, as shown, comprise one or more bends. In doing so, the cutting edge 36 is preferably arranged on the side of the tufting knife 20, said side facing the gripper 18 during use. This cutting edge can be produced in that the front end 31 of the base body 24 is provided with an inclined end surface, said surface meeting, e.g., the flat side 32 on the cutting edge 36.

Preferably, the bending joint 27 is represented by an indentation or a troughed recess 37 that extends transversely to the longitudinal direction of the tufting knife 20 across one of its flat sides 32, 33. The longitudinal direction of the tufting knife 20 is defined by the longitudinal edges 28, 29. In doing so, the recess 37, as shown, may extend at a right angle to the longitudinal direction. The edges 38, 39 of the recess 37 are obviously oriented at a right angle to the longitudinal edges 28, 29. However, they may also be oriented at an acute angle to the longitudinal direction, as is indicated by dashed lines in FIG. 3.

The bending joint defines a joint axis 40, said axis extending transversely to the longitudinal direction of the tufting knife 20. In doing so, as shown, said axis may also extend at a right angle, or also at an acute angle, to the longitudinal direction of the tufting knife. The latter is the case when the edges 38, 39—as indicated by the dashed lines—are not oriented at a right angle to the longitudinal direction. Consequently, due a specific inclination of the recess 37, it is possible to specifically adjust the bending and torsional conditions of the tufting knife 20.

Preferably, the recess 37 follows an arcuate curvature, as is obvious from FIG. 4, in particular. The radius R at which the bottom of the recess 37 is curved is preferably two to three times greater than the width 35 of the tufting knife 20. The distance of the center of the recess 37 from the cutting edge 36 is preferably smaller than half the radius of curvature R and is greater than one third of said radius. The center of the recess 37 is located in the center between the edges 38, 39 and approximately corresponds to the location of the hinge axis 40. The edges 38, 39 are those lines where the curved bottom of the recess 37 meets the flat side 33. The center 41 of the cutting edge (see FIG. 3) is used as the reference point for measuring the distance to the cutting edge.

The tufting device 10 that has been described so far works as follows:

In operative mode, the gripper bar 19 and the knife bar 21 are moved relative to each other in such a manner that the tufting knife 20 performs a cutting motion toward the lower edge of the gripper 18. In doing so, the flat sides 32 of the cutting knives 20 abut against the grippers 18, sliding along said flat sides. In doing so, they are flexibly deformed and biased against the lateral surface of the respective gripper 18, whereby the bending joints 27, as is obvious from FIG. 2, yield in an elastic manner and thus generate, in a resilient manner, the desired contact pressure between the tufting knife and the gripper 18. As a result, the legs 25, 26 will deform more or less. The deformation is essentially concentrated on the bending joint 27. Again, FIG. 5 is an exaggerated depiction of this.

In the bending joint 27, i.e., in the region of the recess 37, the thickness 34 decreases at its thinnest point to a minimum thickness 42 that is found in the center of the recess 37. This point of minimum thickness 42 defines the position of the joint axis 40. The bending joint 27 provides a desired high flexibility of the tufting knife 20. The leg 26 is able to flexibly yield to the grippers 18, without generating excessive contact forces as a result of this. The spring characteristic of the tufting knife is substantially softer than that of an equally thick tufting knife without a bending joint 27. Consequently, the tufting device 10 is substantially more robust, less sensitive to misadjustments of the cutting gap and is more durable. In particular, the abrasive wear between the tufting knives 20 and the grippers 18 is reduced.

Figure 6:
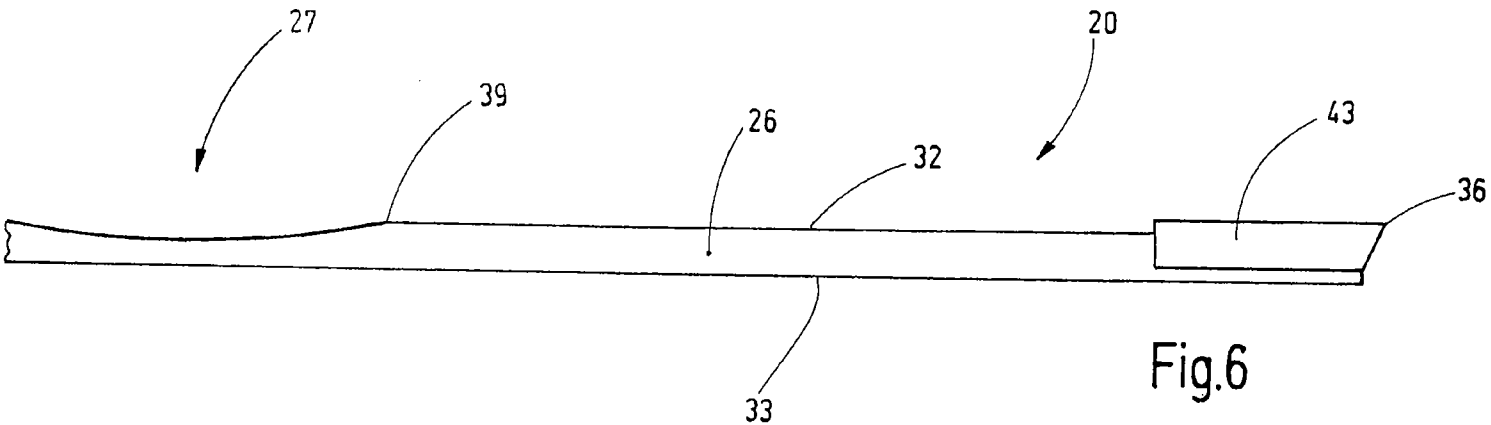

The tufting knives in accordance with the invention can be modified in many ways. For example, the bending joint 27 is preferably provided on the flat side 33 of the tufting knife 20 away from the cutting edge 36 (see FIG. 4). However, the joint may also be provided on the opposite side, as indicated in FIG. 6. In addition, it may be advantageous to provide corresponding recesses on both flat sides 32, 33. The recesses may be produced by material removal or also by material displacement. The recesses on both flat sides 32, 33 may have the same or different forms and/or positions. As shown, the edges 38, 39 may be straight as shown, or also be curved. For example, the edges 38, 39 on the longitudinal edges 38, 29 may be at a greater distance from each other than in a central region.

Figure 7:
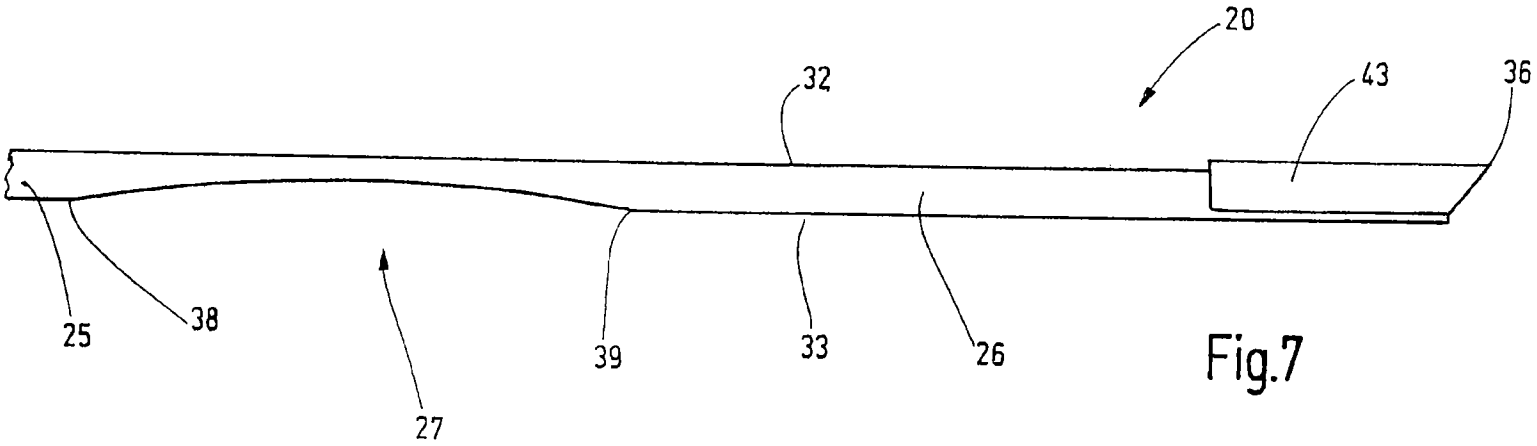
FIGS. 6 and 7 are front views of details of modified embodiments of the tufting knife in accordance with the invention.

As is further obvious from FIG. 6, as well as from FIG. 7, the cutting edge 36 on a hard material insert 43 may, for example, be made of ceramic, hard metal or the like. This insert can be soldered, or joined in another way, to the base body 24 of the tufting knife 20. This can be accomplished in that the leg 26 has an appropriate receptacle, e.g., in the form of a pocket, in or on which the cutting insert 43 is arranged. Other than that, the above description is additionally applicable.

An improved tufting knife 20 has, at a distance from its cutting edge 36, a bending joint 27 from which extends one leg 26 to the cutting edge 36 and another leg 25 to a knife bar 21. The bending joint 27 ensures that the tufting knife 20 is highly flexible and that a desired contact pressure between the tufting knife 20 and the gripper 18 is maintained largely independently of the degree of lateral flexion and/or bending of the tufting knife 20. This has a strongly wear-reducing effect.

LIST OF REFERENCE NUMERALS

10 Tufting device
11 Backing material
12 Tufting needles
13-16 Loops
17 Reed finger
18 Gripper
19 Gripper bar
20 Tufting knife
21 Knife bar
22, 23 Cut loops
24 Base body
25 Holding leg
26 Cutting leg
27 Bending joint
28, 29 Longitudinal edge
30 End on holding block side
31 End on cutting edge side
32, 33 Flat sides of the tufting knife 20
34 Thickness of the tufting knife 20
35 Width of the tufting knife 20
36 Cutting edge
37 Recess
38, 39 Edges of recess 37
40 Joint axis
R Radius
41 Center of the cutting edge 36
42 Minimum thickness
43 Cutting insert

What is claimed is:

1. Tufting knife (20) for a tufting machine, said tufting knife comprising:

an elongated strip-shaped base body (24), a cutting edge (36) provided on one end (31) of the base body (24), a bending joint (27) provided at a distance from the cutting edge (36) wherein the bending joint (27) is a spring loaded hinge configured so as to represent a resilient section of the base body (24) characterized in that the resilient section has a lower material thickness (42) than the remaining base body (24).

2. Tufting knife (20) for a tufting machine, said tufting knife comprising:

an elongated strip-shaped base body (24), a cutting edge (36) provided on one end (31) of the base body (24), a bending joint (27) provided at a distance from the cutting edge (36) characterized in that the bending joint (27) is formed by a troughed recess (37) in at least one of the flat sides (32, 33) of the base body (24), further characterized in that the base body (24) has two flat sides (32, 33), said flat sides being delimited by longitudinal edges (29, 28), and that the cutting edge (36) connects the longitudinal edges (29, 28) with each other.

3. Tufting knife as in claim 2, characterized in that the troughed recess (37) extends across an entire width (35) of the flat side (32, 33).

4. Tufting knife as in claim 3, characterized in that, along its length, the recess (37) has a constant cross-section.

5. Tufting knife as in claim 2, characterized in that the recess (37) has a rounded bottom.

6. Tufting knife (20) for a tufting machine, said tufting knife comprising:

an elongated strip-shaped base body (24), a cutting edge (36) provided on one end (31) of the base body (24), a bending joint (27) provided at a distance from the cutting edge (36), characterized in that a minimum thickness (42) of the base body (24) at a recess (37) is essentially half the thickness (34) of the tufting knife (20).

7. Tufting knife as in claim 2, characterized in that the recess (37) follows a radius of curvature (R) that is approximately twice as large as twice the width (35) of the tufting knife (20).

8. Tufting knife (20) for a tufting machine, said tufting knife comprising:

an elongated strip-shaped base body (24), a cutting edge (36) provided on one end (31) of the base body (24), a bending joint (27) provided at a distance from the cutting edge (36), characterized in that the distance of a center of a recess (37) from the cutting edge (36) is smaller than half the radius of curvature (R) and greater than one third of a radius of curvature (R).

* * * * *